United States Patent [19]

Nicolay et al.

[11] 4,446,803

[45] May 8, 1984

[54] UPPER FABRIC FEED FOR A SEWING MACHINE

[75] Inventors: Karl Nicolay; Klaus Hampel, both of Bielefeld, Fed. Rep. of Germany

[73] Assignee: Dürkoppwerke GmbH, Bielefeld, Fed. Rep. of Germany

[21] Appl. No.: 351,871

[22] Filed: Feb. 24, 1982

Related U.S. Application Data

[63] Continuation-in-part of Ser. No. 321,073, Nov. 13, 1981, abandoned.

[30] Foreign Application Priority Data

Nov. 15, 1980 [DE] Fed. Rep. of Germany ..... 3043141

[51] Int. Cl.[3] ..... D05B 27/04

[52] U.S. Cl. ..... 112/320

[58] Field of Search ..... 112/320, 262.1

[56] References Cited

U.S. PATENT DOCUMENTS 3,935,826 2/1976 Nicolay et al. ..... 112/320

4,067,275 1/1978 Willenbacher ..... 112/320

4,116,145 9/1978 Nicolay ..... 112/320

*Primary Examiner*—Werner H. Schroeder

*Assistant Examiner*—Andrew M. Falik

*Attorney, Agent, or Firm*—Karl F. Ross; Herbert Dubno

[57] ABSTRACT

A fabric feed for a sewing machine has a feed foot and a holddown foot that are vertically oppositely reciprocable between upper positions and lower fabric-engaging positions, and a continuously operating rotary drive with a rotating output whose rotary motion is transformed by an appropriate linkage into alternating reciprocation of the feed foot and the holddown foot. The feet are alternately engaged with and disengaged from fabric in the fabric-engaging position. On moving downwardly from their upper into their lower positions the feet are each first accelerated to a maximum speed reached when approximately midway between the upper and lower positions and thereafter are decelerated to an intermediate speed lying between zero and seven-tenths of the maximum speed reached when they attain the lower fabric-engaging position.

7 Claims, 7 Drawing Figures

16
7
6
15
21'
19
18
17
20
25
20'
23'
23
22
12
14
13
12'
11
10
8
9
5
4
2
1
3

UPPER FABRIC FEED FOR A SEWING MACHINE

CROSS-REFERENCE TO RELATED APPLICATION

This application is a continuation-in-part of copending patent application No. 321,073 filed Nov. 13, 1981, abandoned.

FIELD OF THE INVENTION

The present invention relates to an upper fabric feed for a sewing machine. More particularly this invention concerns such a fabric feed for a sewing machine having separate upper feed and holddown feet.

BACKGROUND OF THE INVENTION

Earlier U.S. Pat. No. 4,116,145 as well as commonly owned U.S. Pat. No. 3,196,815 disclose a sewing machine having separate feed and holddown feet. These feet lie immediately adjacent each other and are oppositely vertically displaced. The feed foot can also be horizontally reciprocated. These two feet coact with a lower feed foot or dog provided under the sewing-machine stitch plate and jointly horizontally reciprocated with the upper feed foot.

The upper feed foot normally is brought down onto the goods lying on the lower feed foot and once the goods are pinched between these feed feet the holddown foot is lifted. Then the two feed feet move a step forward to advance the goods an increment, after which the holddown foot is dropped to pinch the thus-advanced goods against the stitch plate. The upper and lower feed feet are then respectively raised and lowered, then moved one step back to their starting positions, so that they can again pinch the goods and advance them one more increment. In this manner positive advance is insured even at relatively high speed.

My earlier above-cited U.S. Pat. No. 4,116,145 converts the rotary motion of the main upper drive shaft of the machine into reciprocating vertical motion of these feet by means of a crank disk connected to a bell crank via an input crank. The bell crank in turn swings a composite connecting rod comprising a sliding link which interconnects the bell crank with a ternary link carrying the feet and comprising a guide bar for guiding the sliding link. The ternary link is urged by a spring toward the stitch plate by a swingable arm and alternatingly lifts the pressure and feed feet. The velocity of these feet is reduced sinusoidally toward zero as they come into engagement with the material being sewn.

This system described immediately above is an improvement on the earlier system described in the other above-cited U.S. Pat. No. 3,196,815. In that arrangement the velocity of the feet is at a maximum when they come to their lower end positions in which they contact the goods. Reducing the velocity to zero as the feet come into engagement with the goods reduces the tendency of the feet and goods to bounce and flutter, especially in high-speed work. In addition the system of my earlier patent eliminates the necessity of providing dampers for the feet to absorb some of the energy of the contact blow.

In the known arrangements the ternary link carrying the two feet is urged downwardly by a compression spring whose compression can be adjusted to vary the foot pressure in a manner well known in the art. This spring also compensates for the various forces which are created in the linkage especially when working at high speed. When a strong spring is used there is the danger of damaging the goods being sewn; when a weak spring is used vibration or flutter is likely. In addition a strong spring exposes the various pivots to considerable wear and generally makes the machine work under a heavier load than is strictly necessary for the job at hand.

OBJECTS OF THE INVENTION

It is therefore an object of the present invention to provide an improved upper fabric feed for a sewing machine.

Another object is the provision of such a feed which overcomes the above-given disadvantages.

A further object is to provide an upper fabric feed which can operate at extremely high speed.

SUMMARY OF THE INVENTION

These objects are attained according to the instant invention in a method of operating a fabric feed for a sewing machine wherein, as is well known in the art, a feed foot and a holddown foot are vertically oppositely reciprocable between upper positions and lower fabric-engaging positions, a continuously operating rotary drive has a rotating output whose rotary motion is transformed by an appropriate linkage into alternating reciprocation of the feed foot and the holddown foot, and the feet are alternately engaged with and disengaged from fabric in the fabric-engaging position. According to this invention on moving downwardly from their upper into their lower positions the feet are each first accelerated to a maximum speed reached when approximately midway between the upper and lower positions and thereafter are decelerated to an intermediate speed lying between zero and seven-tenths of the maximum speed reached when they attain the lower fabric-engaging position.

It has surprisingly been found according to the instant invention that reducing the speed the feet are displaced with to a level which lies between zero and about half of the maximum foot speed does not surely suppress a tendency to vibrate with thick fabrics which themselves inherently damp vibration. With thinner fabrics theres is some tendency to vibrate, as is known from above-cited U.S. Pat. No. 3,196,815 wherein the feet are engaged with the goods at maximum speed. This disadvantage is however outweighed by the advantage that as the feet move down they are accelerating less and as a result it is possible to use a weaker compression spring for compensating for the correspondingly reduced energy of the system. As a result the disadvantages of the system of above-cited U.S. Pat. No. 4,116,145 are reduced to a tolerable level so that the machine can operate at a much faster rate. In fact it is possible to operate the machine according to this invention at a rate of up to 5000 RPM, which is substantially higher than the top speed of 2800–3000 RPM hitherto obtainable.

DESCRIPTION OF THE DRAWING

The above and other features and advantages will become more readily apparent from the following, reference being made to the accompanying drawing in which.

SPECIFIC DESCRIPTION

Figure 1:
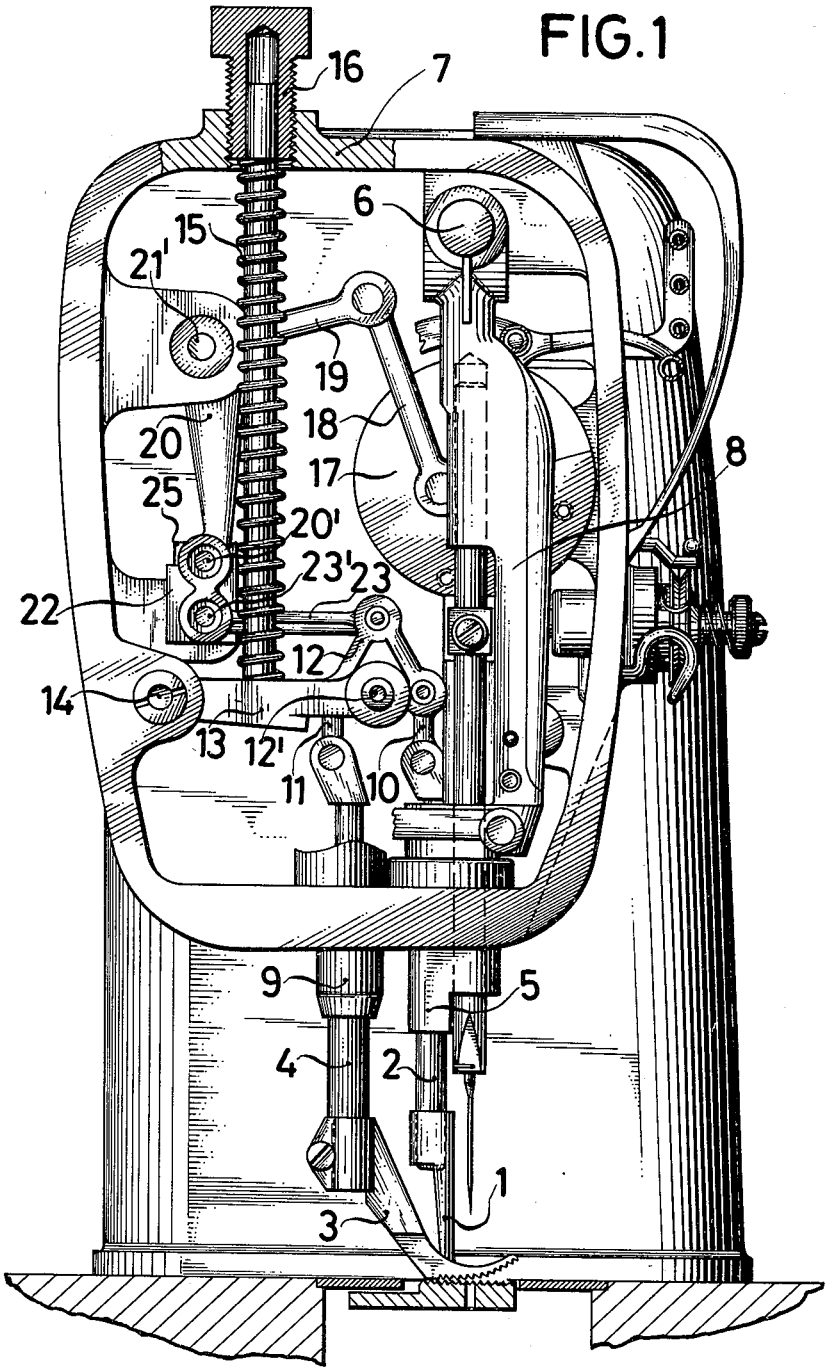
FIG. 1 is an elevational end view of a sewing machine embodying the feed according to this invention.

As described in my U.S. Pat. No. 4,116,145 and also in U.S. Pat. No. 3,935,826, to which reference should be made for further details, a sewing machine has a feed foot 1 and a presser or holddown foot 3. The feed foot 1 and presser foot 3 are carried on the lower ends of respective vertical rods or shafts 2 and 4. The rod 2 is vertically slidable in a horizontally displaceable sleeve 5 which is part of a swing lever 8 that is pivoted at 6 on the sewing-machine housing 7. The lever 8 is oscillated to move the foot 1 back and forth in the plane of the drawing to advance the goods engaged under the foot 1 in a manner well known in the art. The shaft 4 is guided in a bushing 9 fitted in the lower wall of the housing 7.

Figure 2:
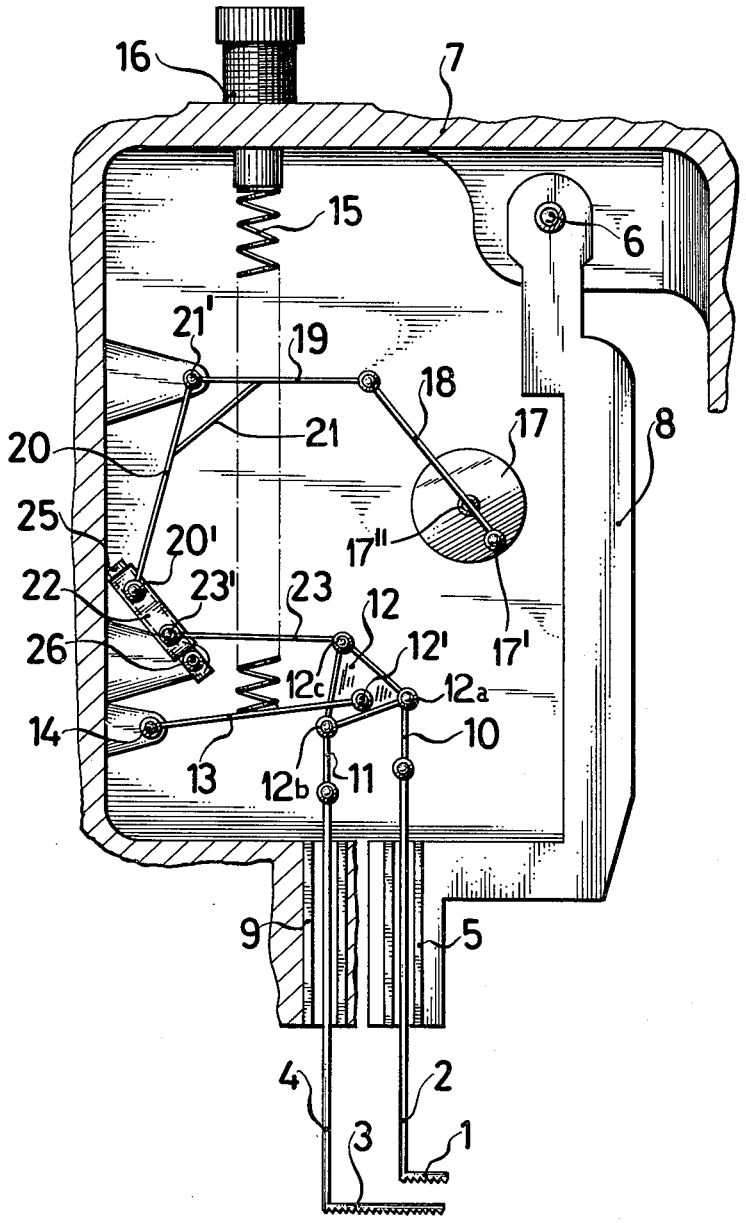
FIG. 2 is a schematic view of the structure of FIG. 1 with the feed foot raised.

The shafts 2 and 4 are connected at their upper ends by means of respective short links 10 and 11 to respective corners **12*a* and 12*b* (see FIG. 2) of a floating triangular or ternary link 12 itself pivoted at a point 12' approximately equidistant between these corners 12*a* and 12*b* on one end of a lever 13 pivoted at 14 on the housing 7. This lever 13 in turn is urged downwardly by a compression spring 15 bearing at its upper end on a sleeve 16 screwed into the housing 7** and constituting the standard sewing-machine pressure adjustment.

A third corner or pivot **12*c* of the ternary link 12, which is equilateral and equiangular between its corner pivots 12*a–c*, is connected by a link 23 to a pivot 23' on a guide or link slide 22 carried on a rod 25 pivoted at a guide pivot 26 on the machine housing 7. This slide 22 has another pivot 20' connected to one arm 20 of a bell crank 21 pivoted at 21' on the housing 7 and having another arm 19 connected via a connecting link 18 to an eccentric pivot 17' on a disk 17 rotated about a horizontal axis 17''. The pivots 6, 12*a–c*, 14, 20', 17', 17'', 21', 23', and 26** all define parallel horizontal pivot axes.

Figure 3:
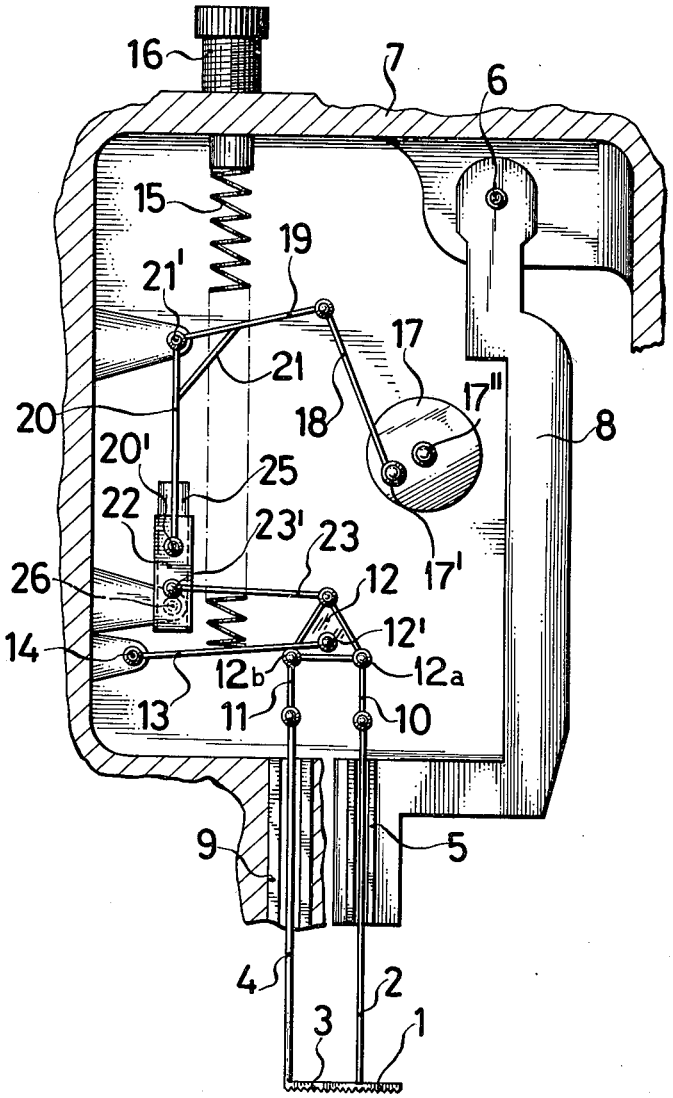
FIG. 3 is a view similar to FIG. 2 but showing the feed and holddown feet at the same level.

With this system the feet 1 and 3 move alternately oppositely up and down. The speed of these feet 1 and 3 decreases proportionately as the pivot 23' of the slider 22 approaches the pivot 26. The speed would drop to zero if the two pivots 23' and 26 were to coincide, that is, if the two pivots 23' and 26 could be coaxial, angular motion of the slider all alone will have no effect on the feet which would therefore be stationary. According to the invention the eccentric drive formed by the disk 17, eccentric pivot 17' and link 18 is dimensioned such that the pivot 23' is closest to the pivot 26 when it is directly above it as shown in FIG. 3. Thus the main difference between the structure of the instant invention and that of my above-cited U.S. Pat. No. 4,116,145 is that these two pivots 23' and 26 do not coincide in this vertical position of the slider 22. This is achieved principally by shortening the arm 20 and lengthening the link 23 slightly in the system of this invention.

Figure 4:
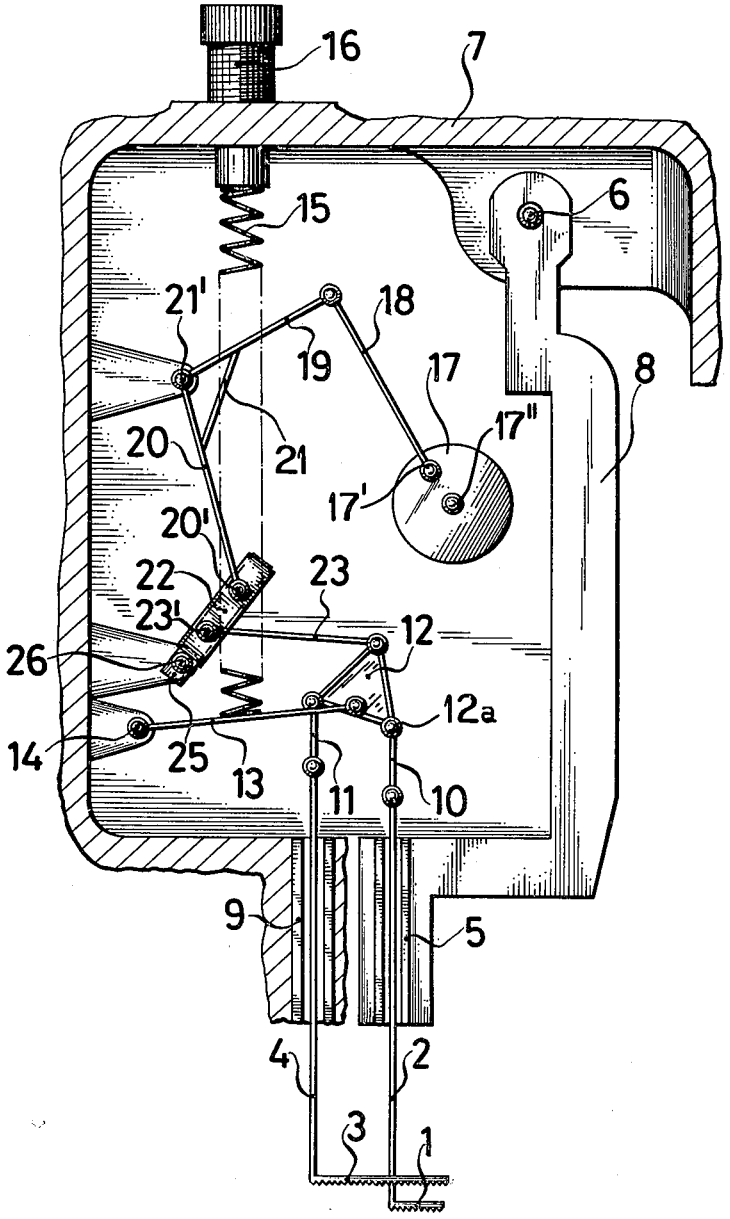
FIG. 4 is a view similar to FIG. 2 but showing the holddown foot raised.

More particularly, the bell crank 21 is oscillated back and forth above its pivot 21' at a rate which is at a maximum in its central position (FIG. 3) and which sinusoidally drops to zero at each end position (FIGS. 2 and 4) as is standard for any machine element reciprocated or oscillated from an eccentric-crank drive. Since a rigid arm 20 of the bell crank 21 is connected to the link slide 22 this element will also come sinusoidally to a halt in its two end positions (FIGS. 2 and 4) and move at maximum angular speed in its central positions (FIG. 3). Simultaneously with this angular motion, however, the slide 22 is pumped up and down, that is reciprocated radially, on the guide 25 between the two end positions of FIGS. 2 and 4. In these end positions maximum velocity is transmitted from the link 22 to the ternary link 12 since the spacing between the pivots 23' and 26 is at a maximum. In the middle position of FIG. 3 in which the two pivots 23' and 26 are relatively close to each other, but not coaxial, minimum velocity is imparted from the link 22 to the floating ternary link 12.

The oscillation rate of the ternary link 12 about its axis 12' is therefore a function of the direction and displacement rate of the slide 22. Since, however, the two pivots 23' and 26 are never coaxial, the ternary link 12 does not stop momentarily in its oscillation in the middle position (FIG. 3). This style of motion is shown in FIG. 7 and can be compared with the styles of motion of the prior-art systems shown in FIGS. 5 and 6.

Figure 5:
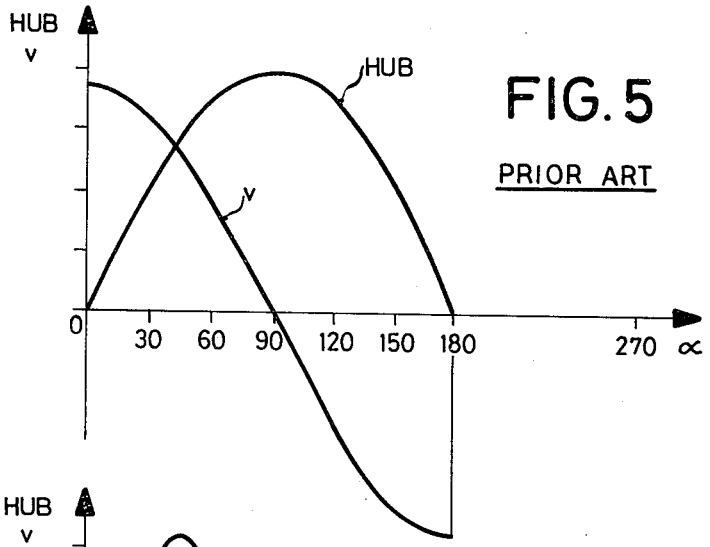
FIG. 5 PRIOR ART
FIGS. 5 and 6 are diagrams illustrating the operation of prior-art feed systems.
Figure 6:
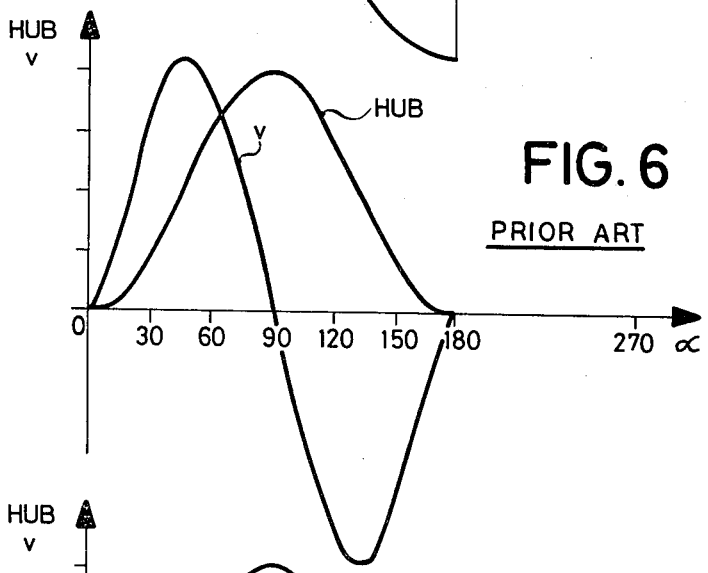
FIG. 6 PRIOR ART

FIG. 5 in particular shows the relationship of foot speed v to position HUB in the prior-art system of above-mentioned U.S. Pat. No. 3,196,815. Here the foot speed v is at a maximum just as the goods are engaged. In FIG. 6 the arrangement of my earlier U.S. Pat. No. 4,116,145 is shown to be different, with the foot speed being zero when the feet engage the fabric.

Figure 7:
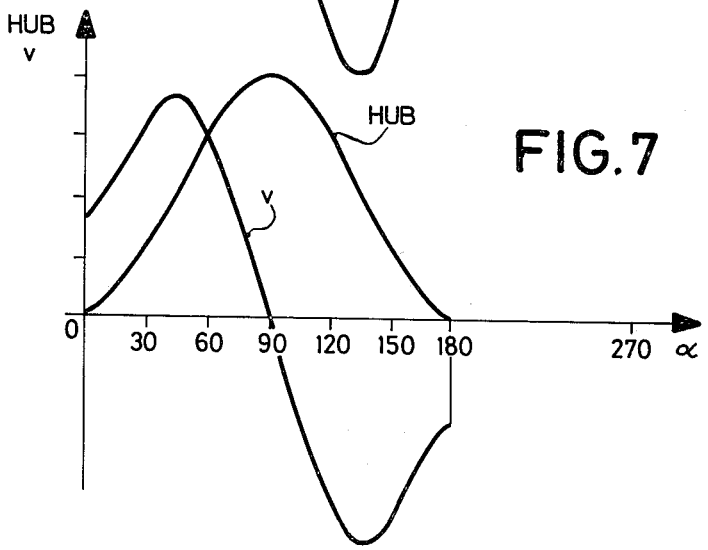
FIG. 7 is a diagram illustrating the feed system according to the present invention.

According to the instant invention as shown in FIG. 7 the feet are moving at a velocity v equal to more than zero and less than seven-tenths of their maximum speed when they engage the goods. Obviously the two feet 1 and 3 always move oppositely vertically, and they alternately press down on the goods.

I claim:

1. In a method of operating a fabric feed for a sewing machine wherein:

a feed foot and a holddown foot are each vertically oppositely reciprocable between a respective upper position and a respective lower fabric-engaging position;

a continuously operating rotary drive has a rotating output whose rotary motion is transformed by an appropriate linkage into alternating reciprocation of the feed foot and the holddown foot; and the feet are alternately engaged with and disengaged from fabric in the respective fabric-engaging positions, the improvement wherein:

on moving downward from their upper into their lower positions the feet are each first accelerated to a maximum speed reached when approximately midway between said upper and lower positions and thereafter are decelerated to an intermediate speed lying between zero and seven-tenths of said maximum speed reached when they attain the respective lower fabric-engaging position.

2. In a sewing machine having feed and holddown feet each vertically displaceable between a respective upper position and a respective lower fabric-engaging position; and a drive having a rotary output and a linkage for transforming the rotary motion of said output into alternating reciprocation of said feed and holddown feet for alternately engaging and disengaging said feet from fabric in the respective fabric-engaging positions, the improvement comprising means in said drive for first accelerating said feet as same move downward from thier upper into their lower positions to a maximum speed reached when approximately midway between said upper and lower positions and for thereafter decelerating said feet to an intermediate speed lying between zero and seven-tenths of said maximum speed and reached when said feet attain the respective lower fabric-engaging positions.

3. The sewing machine defined in claim 2 wherein said linkage comprises:

an eccentric carried on said rotary output and orbiting thereabout on rotation of same;

a first rigid link having one end connected to said eccentric;

a pivotal bell crank having one arm connected to the other end of said first rigid link and another arm;

a guide pivotal about a guide pivot;

a slide link slidable on said pivotal guide radially of the pivot axis thereof and defining a pair of slide-link pivots, said other arm of said bell crank being connected to one of said slide-link pivots;

a second rigid link having one end connected to the other of said slide-link pivots;

a ternary link having a first pivot connected to the other end of said second rigid link, a second pivot connected to said feed foot, a third pivot connected to said holddown foot, and a fourth pivot lying within the outline of said first, second, and third pivots; and a third rigid link having one end connected to said fourth pivot and another end pivoted at a fixed location on said machine.

4. The sewing machine defined in claim 3 wherein the axes defined by said pivots are all substantially parallel.

5. The sewing machine defined in claim 3 wherein said slide link is displaceable on said guide between a pair of end positions in one of which said other slide-link pivot is relatively far from said guide pivot and in the other of which said other slide-link pivot is relatively close to but spaced from and not coaxial to said guide pivot.

6. The sewing machine defined in claim 3, further comprising spring means for urging said third rigid link downward with a predetermined force.

7. The sewing machine defined in claim 3 wherein said first, second, and third pivots of said ternary link are generally angularly equispaced and define an equilateral triangle.

* * * * *